US012460899B2

(12) United States Patent
Noji et al.

(10) Patent No.: US 12,460,899 B2
(45) **Date of Patent: *Nov. 4, 2025**

(54) PNEUMATIC PROJECTILE LAUNCHING SYSTEM

(71) Applicant: POLARSTAR ENGINEERING & MACHINE LLC, Newark, DE (US)

(72) Inventors: Benjamin Noji, Landenberg, PA (US); Rodd Rambo, Smyrna, DE (US)

(73) Assignee: Polarstar Engineering & Machine, LLC, Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/407,070

(22) Filed: Jan. 8, 2024

(65) Prior Publication Data

US 2025/0027745 A1 Jan. 23, 2025

Related U.S. Application Data

(63) Continuation of application No. 17/676,326, filed on Feb. 21, 2022, now Pat. No. 11,867,476, which is a continuation of application No. 17/004,086, filed on Aug. 27, 2020, now Pat. No. 11,255,632.

(60) Provisional application No. 62/913,901, filed on Oct. 11, 2019.

(51) Int. Cl.
*F41B 11/00* (2013.01)
*F41B 11/723* (2013.01)

(52) U.S. Cl.
CPC ..... *F41B 11/723* (2013.01)

(58) Field of Classification Search
CPC ..... F41B 11/62; F41B 11/72; F41B 11/723; F41B 11/71; F41B 11/64; F41A 3/58; F41A 3/66; F41C 7/11
USPC ..... 124/71–77, 56
See application file for complete search history.

(56) References Cited

U.S. PATENT DOCUMENTS

| | | | | | |
|---|---|---|---|---|---|
| 2,273,678 | A * | 2/1942 | Webby | F41B 11/723 | 124/75 |
| 2,299,073 | A * | 10/1942 | Beasley | F41B 11/683 | 137/625.37 |
| 2,940,438 | A * | 6/1960 | Merz | F41B 11/62 | 124/51.1 |
| 3,056,395 | A * | 10/1962 | Merz | F41B 11/62 | 124/31 |
| 5,778,868 | A * | 7/1998 | Shepherd | F41B 11/52 | 124/76 |
| 5,913,303 | A * | 6/1999 | Kotsiopoulos | F41B 11/724 | 124/31 |
| 7,931,018 | B1 * | 4/2011 | Lai | F41B 11/721 | 124/75 |
| 10,955,216 | B2 * | 3/2021 | Pedicini | F41B 11/64 | |
| 2003/0047175 | A1 * | 3/2003 | Farrell | F41B 11/71 | 124/56 |
| 2004/0065310 | A1 * | 4/2004 | Masse | F41B 11/71 | 124/75 |

(Continued)

*Primary Examiner* — Michael D David
(74) *Attorney, Agent, or Firm* — Fox Rothschild LLP

(57) ABSTRACT

A pneumatic assembly for a projectile launching system including a body defining a continuous bore. A nozzle is positioned within the bore adjacent the forward end of the body and is moveable between a rearward position wherein the nozzle facilitates passage of a projectile through a projectile port and a forward position wherein the nozzle blocks the projectile port to prevent passage of a projectile therethrough.

4 Claims, 11 Drawing Sheets

SECTION D-D

(56) References Cited

U.S. PATENT DOCUMENTS

| | | | | |
|---|---|---|---|---|
| 2006/0124118 | A1* | 6/2006 | Dobbins | F41B 11/62 124/77 |
| 2006/0162714 | A1* | 7/2006 | Lai | F41B 11/57 124/74 |
| 2006/0162716 | A1* | 7/2006 | Dobbins | F41A 19/12 124/71 |
| 2006/0207586 | A1* | 9/2006 | Jones | F41B 11/721 124/74 |
| 2009/0241931 | A1* | 10/2009 | Masse | F41B 11/71 124/76 |
| 2011/0232618 | A1* | 9/2011 | Gabrel | F41B 11/723 124/73 |
| 2012/0192847 | A1* | 8/2012 | Hague | F41B 11/721 124/73 |
| 2014/0096758 | A1* | 4/2014 | Gardner, Jr. | F16K 27/044 124/73 |
| 2016/0146567 | A1* | 5/2016 | Nachefski | F41B 11/62 124/73 |
| 2018/0120051 | A1* | 5/2018 | Hague | F41B 11/723 |
| 2020/0132412 | A1* | 4/2020 | Pedicini | F41B 11/64 |
| 2021/0108881 | A1* | 4/2021 | Noji | F41B 11/723 |

* cited by examiner

SECTION E-E

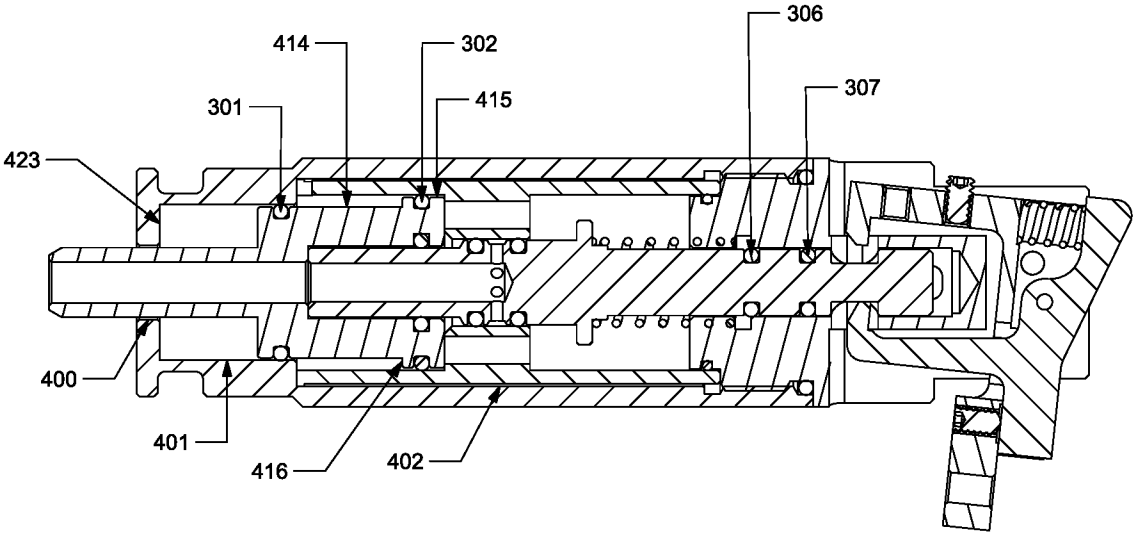
SECTION G-G
FIG 4
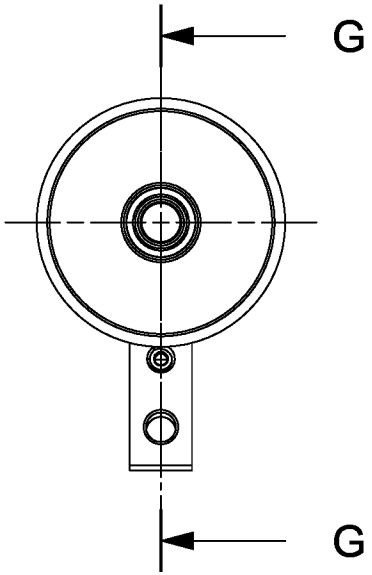

SECTION H-H

SECTION J-J

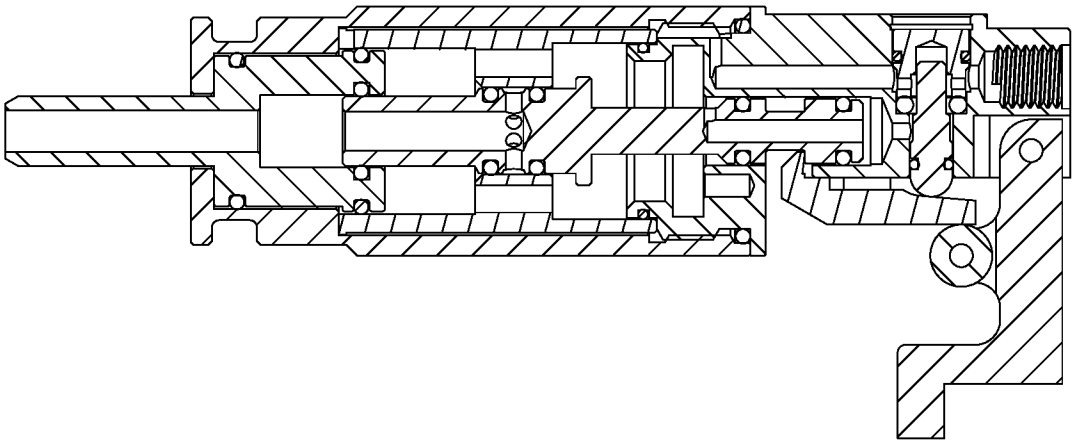
SECTION C-C
FIG 10
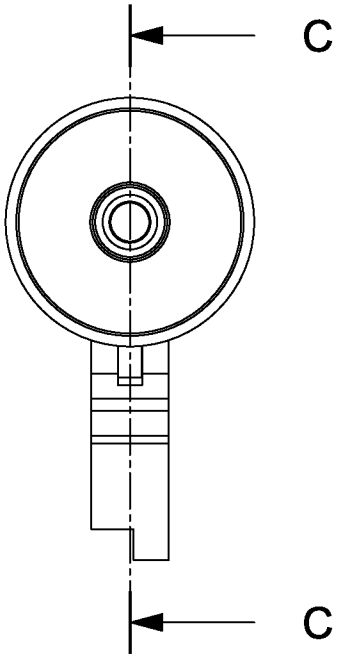

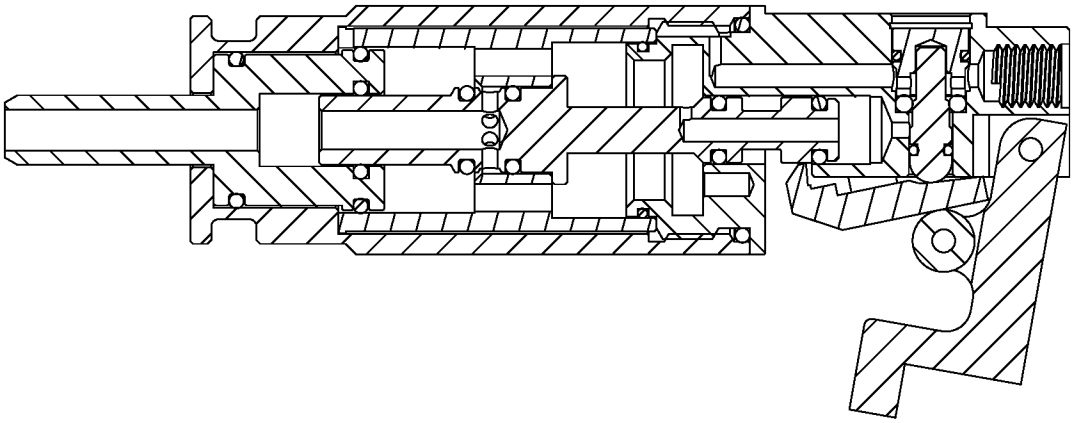
SECTION D-D
FIG 11
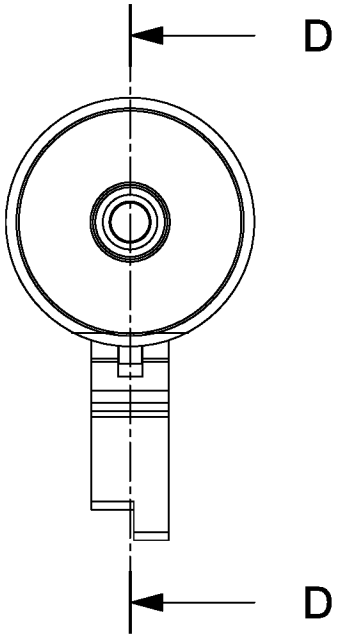

PNEUMATIC PROJECTILE LAUNCHING SYSTEM

FIELD OF THE INVENTION

The present invention relates to a pneumatically operated projectile launching system. A preferred embodiment of the invention is designed for use in airsoft guns.

BACKGROUND OF THE INVENTION

Current airsoft projectile launching systems (as well as non-airsoft systems) include pneumatic and spring power sources. Existing designs suffer from deficiencies that affect accuracy, usability and/or durability.

For example, current spring-powered launching systems use a compressed spring to drive a piston longitudinally within a cylinder, compressing air in front of the piston. As the air is compressed it is directed behind the projectile to launch the projectile from a barrel. The spring may be compressed by human power or by an electric motor. Due to the stresses applied by the compressed spring these types of systems are prone to mechanical failure. Pneumatic launching systems exist but still suffer from shortcomings in performance and usability as well as limitations in compatibility with equipment that is common in the sport of airsoft.

There is therefore a need for improved projectile launching systems.

SUMMARY OF THE INVENTION

An embodiment pneumatically operated projectile launching system preferably comprises a pneumatic assembly housing, a nozzle, a firing valve and a sear mechanism which interfaces with a trigger. The system may be configured for single shot, semi-automatic or fully automatic operation. An alternate embodiment may also be configured for semi-automatic operation in which the nozzle position is controlled by the position of the sear mechanism.

In the semi-automatic configuration, a constant supply of compressed gas is supplied to the input port of the pneumatic system. A nozzle biasing chamber at the front of the nozzle receives a constant supply of gas from the input port. This gas applies a constant rearward biasing force on a surface at the front of the nozzle. A firing chamber behind the nozzle receives gas through a fill port. Flow through the fill port is selectively controlled by the position of the firing valve. When the firing valve is in the rearward (cocked) position gas flows through the fill port into the firing chamber and flow out of the firing chamber is blocked. This allows the firing chamber to fill with compressed gas. Since the rear face of the nozzle is exposed to the gas in the firing chamber, a forward force is applied to the nozzle when the firing chamber is filled. As the surface area acting on the rear of the nozzle is greater than the surface area of the front, the nozzle moves to the forward position to chamber a round. When the firing valve is in the forward (firing) position gas flow from the fill port into the firing chamber is prevented and the gas in the firing chamber is released through the firing valve and directed through the nozzle. When pressure in the firing chamber decreases sufficiently, the constant rearward force acting on the nozzle will overcome the force applied from the firing chamber and the nozzle will accelerate rearward. At a point in the rearward travel of the nozzle, it impinges on a surface of the firing valve and forces the firing valve rearward. When the firing valve reaches a point in the rearward travel the sear mechanism catches a surface of the valve and holds it in the cocked position. The sear mechanism may use a main sear to retain the firing valve in the rear position, and a disconnector to catch the firing valve if the main sear is currently actuated. The firing valve may be biased in the forward direction by a constant force (spring, magnets, gas pressure) or may be selectively biased in the forward direction based on the pressure of the firing chamber.

The fully automatic configuration functions in the same manner as the semi-automatic configuration but includes a striker mechanism to momentarily actuate the disconnector when the nozzle reaches the forward position.

In a single shot configuration the movement of the nozzle is made independent of the pressure of the firing chamber so that it may be actuated manually. The nozzle biasing chamber is omitted and the rear face of the nozzle is not exposed to the pressure of the firing chamber. A manual cocking device pulls the firing valve rearward. The nozzle may be actuated along with the firing valve or separately.

Various embodiments are designed for use in conventional airsoft guns bodies. Breech, barrel and magazine are provided by the gun body in which an embodiment of the invention is installed. The trigger may be part of the embodiment launching system or part of the gun body. Some embodiments make use of the existing AEG (Automatic Electric Gun) gearbox housing as a host to adapt the launching system to existing airsoft gun bodies; other embodiments can be manufactured as standalone systems which may be installed in place of the original AEG gearbox. Additionally, other embodiments can be manufactured as an integral component of an airsoft gun.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings:

FIG. 4 is a cross-sectional view of the semi-automatic pneumatic assembly of FIG. 1 after firing in a reset: firing valve rearward, nozzle rearward, disconnector engaged position.

FIG. 10 is a cross-sectional view of an exemplary semi-automatic pneumatic assembly with a sear operated cutoff valve in an idle/ready to fire position.

FIG. 11 is a cross-sectional view of the semi-automatic pneumatic assembly of FIG. 10 in the firing position.

DETAILED DESCRIPTION OF THE INVENTION

Although the invention is illustrated and described herein with reference to specific embodiments, the invention is not intended to be limited to the details shown. Rather, various modifications may be made in the details within the scope and range of equivalents of the claims and without departing from the invention. The invention is described below with reference to a compressed gas, however, it is understood that the compressed gas may be any fluid as known to those skilled in the art or which may become discovered by those skilled in the art.

Figure 1:
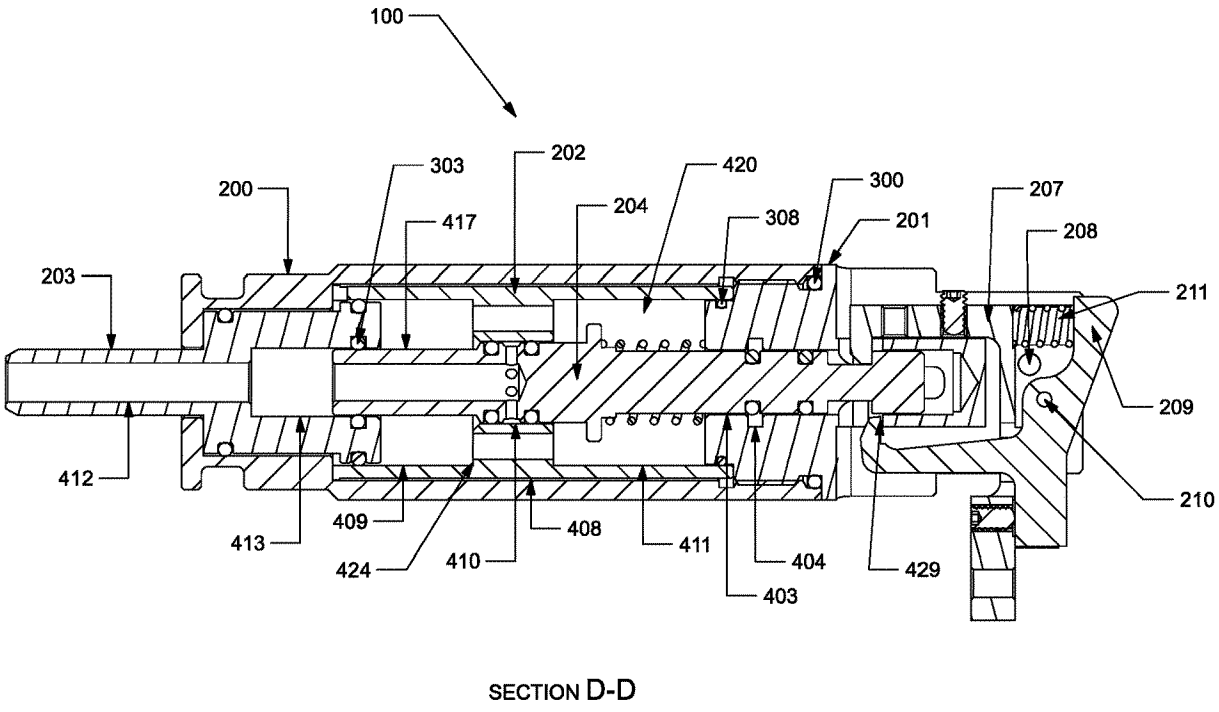
FIG. 1 is a cross-sectional view of an exemplary semi-automatic pneumatic assembly in an idle/ready to fire position.
Figure 1:
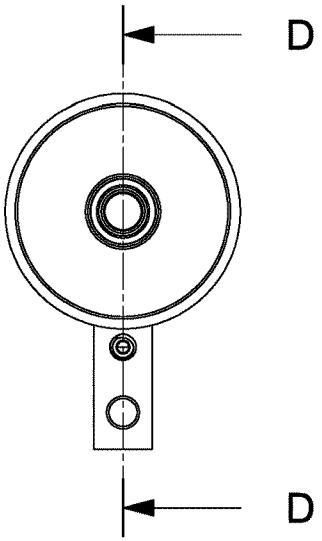
Figure 2:
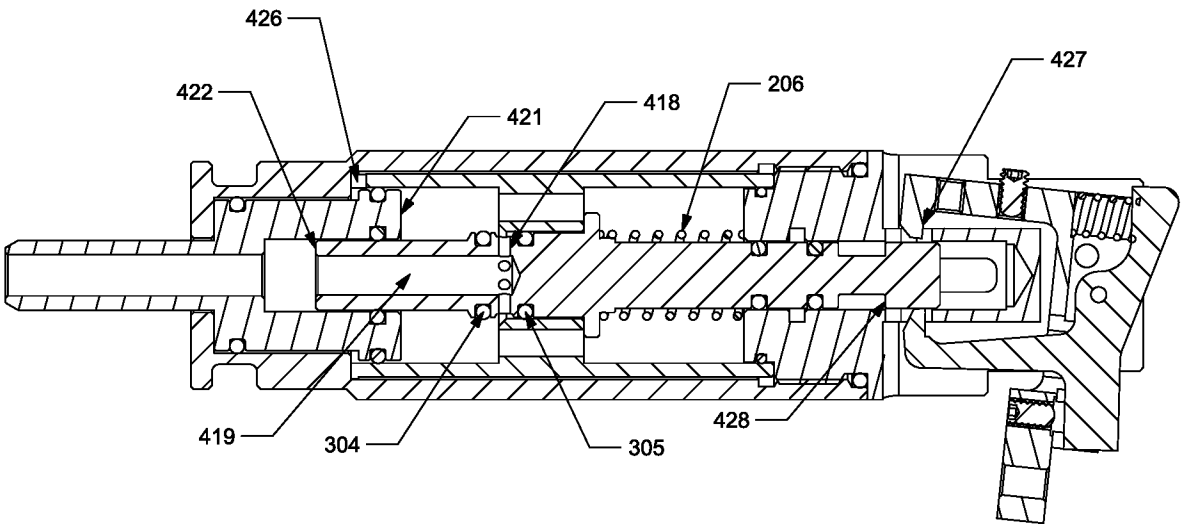
FIG. 2 is a cross-sectional view of the semi-automatic pneumatic assembly of FIG. 1 in a firing: sear released, firing valve forward position.
Figure 2:
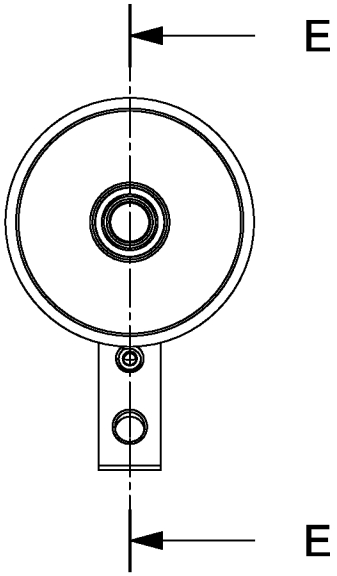
Figure 3:
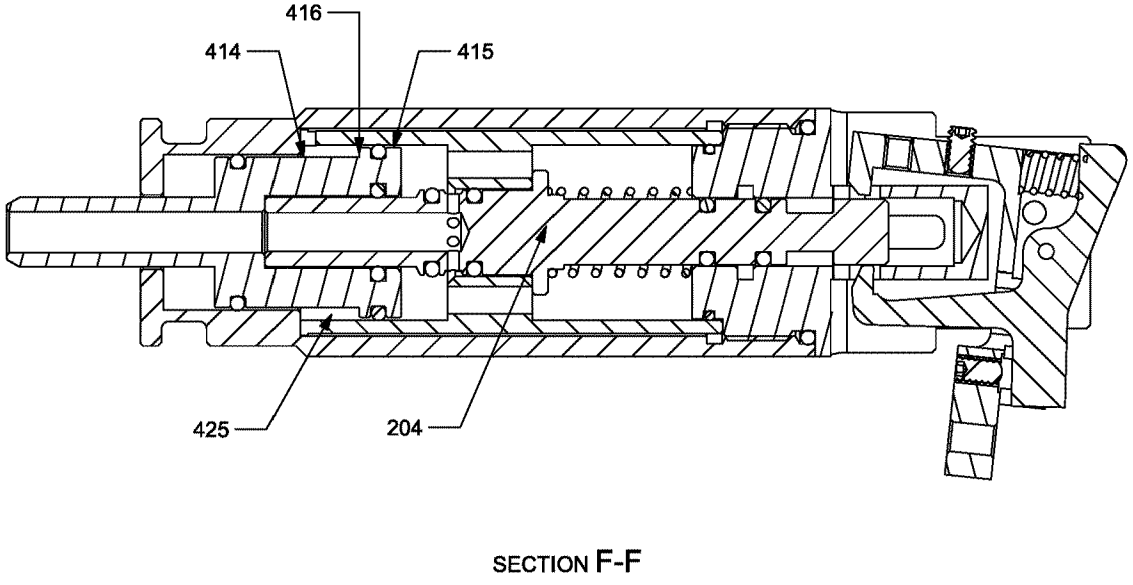
FIG. 3 is a cross-sectional view of the semi-automatic pneumatic assembly of FIG. 1 in a firing: firing valve forward, nozzle partially rearward position.
Figure 3:
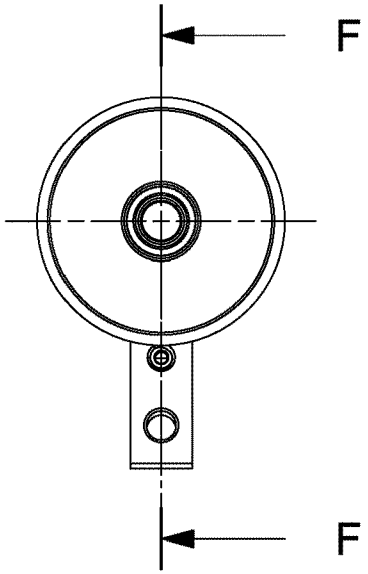
Figure 5:
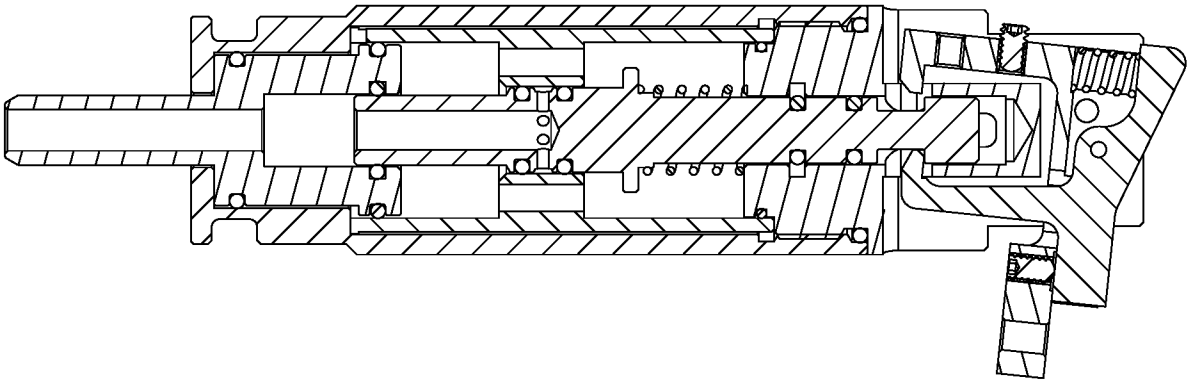
FIG. 5 is a cross-sectional view of the semi-automatic pneumatic assembly of FIG. 1 after firing in a reset: firing valve rearward, disconnector engaged, nozzle forward position.
Figure 5:
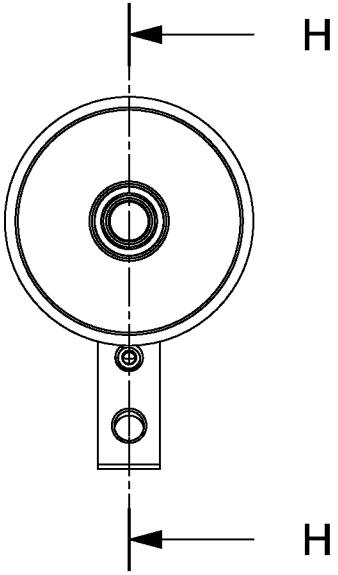
Figure 6:
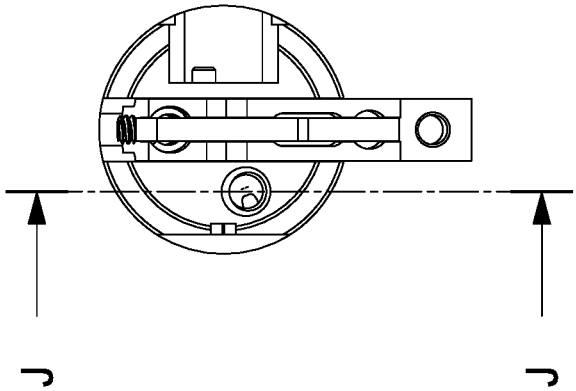
FIG. 6 is a cross-sectional view of the semi-automatic pneumatic assembly of FIG. 1 showing the input port and gas routing.
Figure 6:
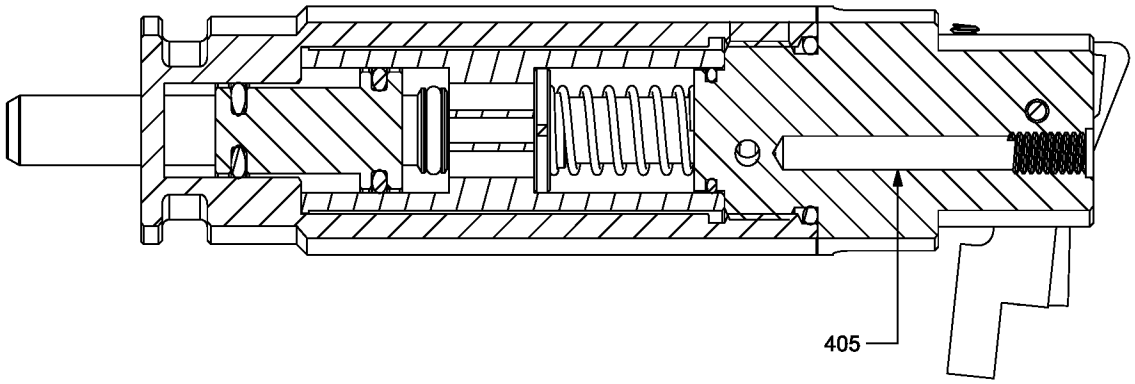
Figure 7:
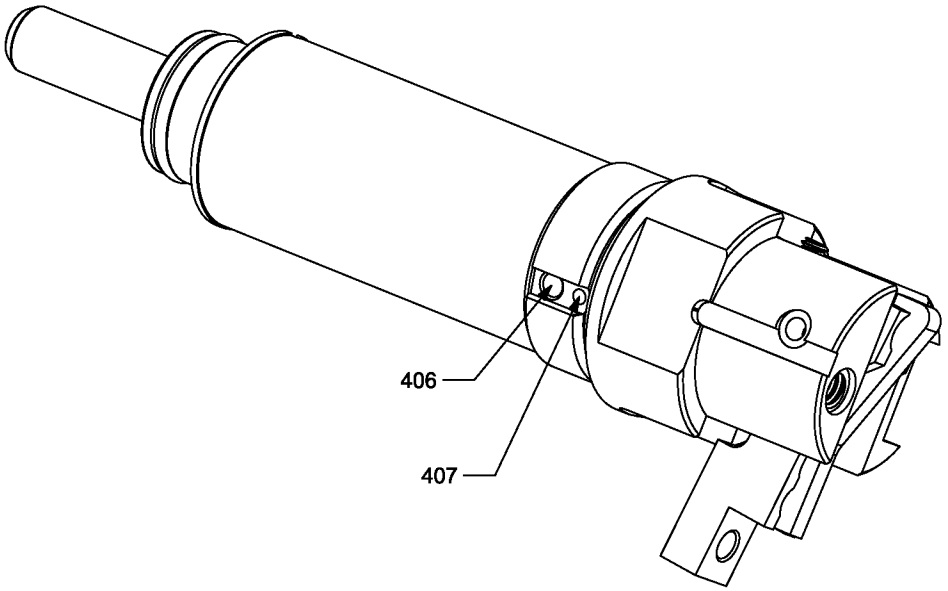
FIG. 7 is a cross-sectional view of the semi-automatic pneumatic assembly of FIG. 1 showing gas routing ports.
Figure 8:
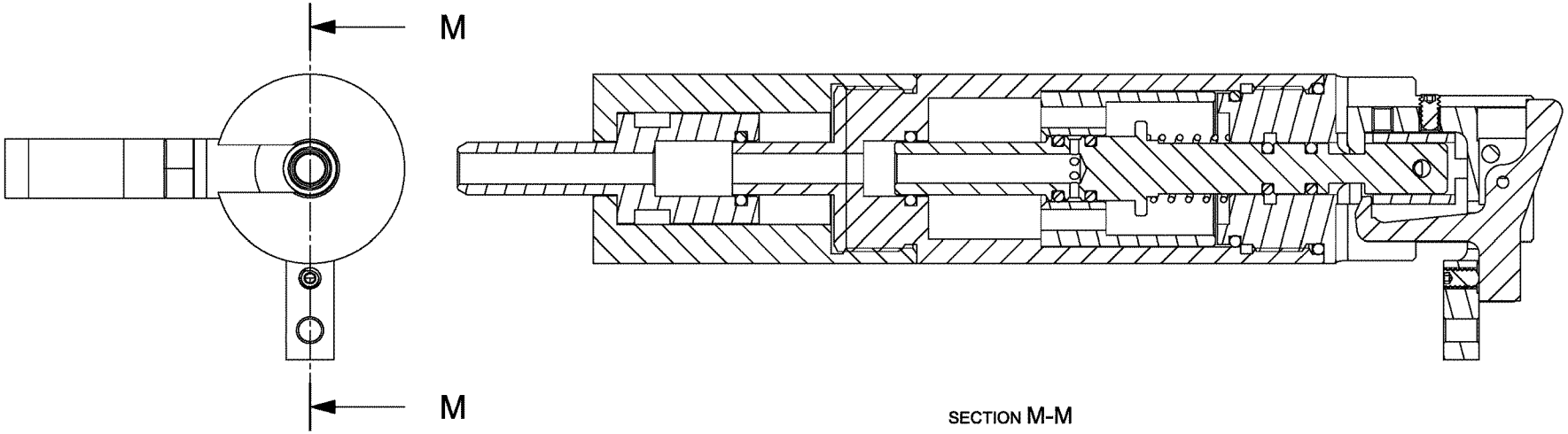
FIG. 8 is a cross-sectional view of an exemplary single shot pneumatic assembly in an idle/ready to fire position.
Figure 9:
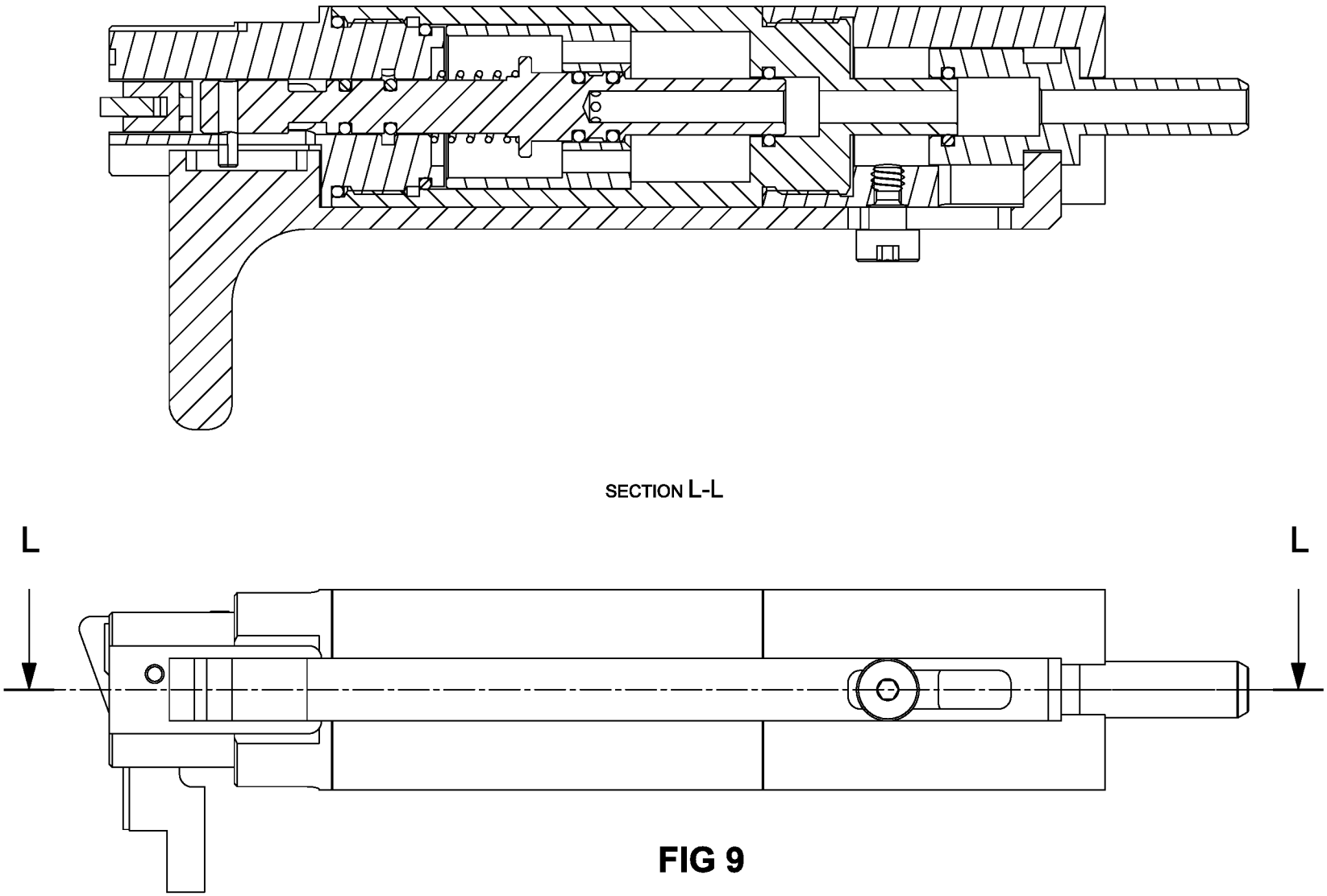
FIG. 9 is a cross-sectional view of the semi-automatic pneumatic assembly of FIG. 8 in the re-cocking position.

Referring to FIGS. 1-7, the exemplary semi-automatic pneumatic assembly 100 includes a front cylinder 200 and a rear cylinder 201 joined longitudinally to house the pneumatic components of the assembly. An o-ring 300 forms a seal at the joint between the front cylinder 200 and the rear cylinder 201. The front cylinder 200 defines a series of bores 400, 401, 402 of varying sizes. The rear cylinder 201 defines a single concentric bore 403 interrupted by a groove 404. The groove 403 is in constant fluid communication with the input port 405 through a series of secondary ports 406,407 in the rear cylinder 201.

A baffle 202 is located concentrically in the rear bore 402 of the front cylinder 201. The outside diameter of the baffle 202 is smaller than the bore 402 of the front cylinder such that a gas passage 408 is formed between them. The gas passage 408 is supplied from the forward secondary port 406 in the rear cylinder 201. The baffle 202 defines a series of concentric bores 409, 410, 411.

A nozzle 203 is located in the center bore 401 of the front cylinder 200 as well as the front bore 409 of the baffle 202. The nozzle 203 defines a series of concentric bores 412,413. A forward external nozzle seal 301 is located on a forward diameter 414 of the nozzle 203 and a rear external nozzle seal 302 is located on a larger rear diameter 415 of the nozzle 203. A nozzle rearward acting area 416 is created due to the difference in diameters 414,415.

The front and rear bores 409,411 of the baffle 203 are in constant fluid communication and form a volume chamber 420. An o-ring 308 forms a seal between the baffle 203 and the rear cylinder 201 to prevent gas flow into the volume chamber 420 from the baffle gas passage 408. The rear external o-ring seal 302 and internal o-ring seal 303 of the nozzle 203 seal the front of the volume chamber 420 and form a nozzle forward acting area 421 on the back face of the nozzle 203.

A valve 204 located within the pneumatic assembly 100 spans from the rear bore of the nozzle 413 to the bore 403 in the rear cylinder 201. A nozzle stem 416 at the front of the valve 204 provides a sealing surface for the nozzle internal seal 303. A pair of exhaust seals 304,305 are located behind the nozzle stem 416. A series of radial holes 418 are located between the exhaust seals 304,305 and connect to the outlet 419 of the valve 204. The exhaust seals 304,305 seal in the center bore 410 of the baffle 202. A pair of filling seals 306,307 at the rear of the valve 204 seal on the bore 403 of the rear cylinder 201. The exhaust seals 304,305 and the filling seals 306,307 are located so that in the forward position of the valve 204 the forward exhaust seal 304 is no longer sealed and allows gas to flow through the valve 204 while the filling seals 306,307 span the groove 404 of the rear cylinder bore 403 to prevent gas flow into the volume chamber 420. In the rearward position the forward filling seal 306 is no longer sealed allowing gas to flow into the volume chamber 420, while the forward exhaust seal 304 is sealed preventing gas from flowing out of the volume chamber 420. A spring 206 biases the valve 204 in the forward direction. The front face 422 of the nozzle stem 417 serves as an impact surface upon which the nozzle 203 impinges upon during its rearward travel.

The center bore 401 of the front cylinder 200 provides a bearing and sealing surface for the forward external o-ring seal 301 of the nozzle 203. The shoulder 423 formed by the forward bores 400,401 of the front cylinder 200 acts as a stop to limit the forward travel of the nozzle 203.

The front bore 409 of the baffle 203 provides a bearing and sealing surface for the rear external o-ring seal 302 of the nozzle 203. The shoulder 424 formed by the two forward bores 409,410 acts as a stop to limit the rearward travel of the nozzle 203. The external nozzle o-ring seals 301, 302 form a nozzle fluid chamber 425 that can receive and release a volume of compressed gas from the baffle gas passage 408 through a port 426 at the front of the baffle 202.

A sear 207 is located at the at the rear of the pneumatic assembly 100 and pivots on an axle 208. A catch surface 427 is located at the front of the sear 207 which interfaces with a surface 428 of the valve 204 to retain it to the rear. The sear 207 is biased in the catch direction by a spring. A secondary sear 209 is located within the sear 207 and pivots on an axle 210. The secondary sear 209 has a catch surface 429 at the front which interfaces with the same surface 428 as the sear 207. A spring 211 between the secondary sear 209 and the sear 207 biases the secondary sear 209 in the catching direction. The locations of the sears 207,209 are arranged such that the catch surface 429 of the secondary sear 209 is located rearward of the catch surface 427 of the sear 207 and will not engage the catch surface 428 of the valve 204 if the sear 207 is already engaged.

What is claimed is:

1. A pneumatic valve mechanism comprising:

a volume chamber;

a valve positioned within the volume chamber, the valve moveable between an exhaust position wherein flow through from the volume chamber through the valve is facilitated while flow into the volume chamber from a fill port is prevented and a filling position wherein flow through from the volume chamber through the valve is prevented while flow into the volume chamber from the fill port is facilitated, the valve being biased to the exhaust position;

a sear having a catch surface configured to engage a surface of the valve to retain the valve in the filling position and to release the valve into the exhaust position when actuated; and a secondary sear having a catch surface configured to engage the surface of the valve to retain the valve in the filling position and to release the valve into the exhaust position when actuated, wherein the catch surface of the secondary sear is located rearward of the catch surface of the sear so that the catch surface of the secondary sear does not engage the surface of the valve when the sear is engaged.

2. The pneumatic valve mechanism of claim 1 wherein the secondary sear catches the valve as it moves into the filling position if the sear is currently actuated, and then releases the valve onto the sear when the sear is longer actuated.

3. A pneumatic assembly for a projectile launching system comprising:

a body defining a continuous bore from a substantially open forward end of the body to a substantially closed rearward end of the body;

the valve mechanism of claim 2;

a nozzle positioned within the bore adjacent the forward end of the body, the nozzle moveable between a rearward position wherein the nozzle facilitates passage of a projectile through a projectile port and a forward position wherein a projectile is fired and nozzle blocks the projectile port to prevent passage of an additional projectile therethrough;

a rear acting area of the nozzle in fluid communication with volume chamber;

a forward acting area of the nozzle onto which a constant rearward biasing force is applied;

an interface between the nozzle and the valve mechanism of claim 2 which applies a force to the valve in the direction of the filling position during a section of the rearward travel of the nozzle.

4. The pneumatic assembly of claim 3, wherein fluid flow into the volume chamber is controlled by the position of the sear and not by the position of the valve.

* * * * *